US005577652A

United States Patent [19]

Cooper

[11] Patent Number: 5,577,652

[45] Date of Patent: Nov. 26, 1996

[54] CONVERTIBLE BACKPACK

[75] Inventor: Cheryl G. Cooper, Seaforth, Australia

[73] Assignee: Cher (Int'l) Pty. Ltd., Australia

[21] Appl. No.: 230,854

[22] Filed: Apr. 21, 1994

Related U.S. Application Data

[63] Continuation of Ser. No. 74,715, Jun. 9, 1993, abandoned, which is a continuation of Ser. No. 773,141, Oct. 8, 1991, abandoned.

[51] Int. Cl.[6] ..... A45F 4/02

[52] U.S. Cl. ..... 224/578; 224/153; 224/580; 224/608; 224/627

[58] Field of Search ..... 224/153, 209, 224/151, 253, 578, 579, 580, 608, 627, 600

[56] References Cited

U.S. PATENT DOCUMENTS

| | | | |
|---|---|---|---|
| 4,810,102 | 3/1989 | Norton | 224/151 |
| 4,836,428 | 6/1989 | Evans et al. | 224/253 |

FOREIGN PATENT DOCUMENTS

| | | | |
|---|---|---|---|
| 170507 | 2/1952 | Austria | 224/153 |
| 313574 | 7/1919 | Germany | 224/209 |
| 3002106 | 7/1981 | Germany | 224/209 |
| 186977 | 10/1936 | Switzerland | 224/153 |
| 1238303 | 7/1971 | United Kingdom | 224/153 |

*Primary Examiner*—Linda J. Sholl
*Attorney, Agent, or Firm*—Blakely Sokoloff Taylor & Zafman

[57] ABSTRACT

A convertible backpack having an anchoring loop centrally disposed near the top of the backpack on a back panel. A single shoulder strap connected to the backpack at both ends and passing slidably through the anchoring loop at its middle dividing the shoulder strap into a left portion and a right portion. Accordingly, the backpack can be easily converted from double shoulder wear, to single shoulder wear, to across the chest wear.

13 Claims, 4 Drawing Sheets

42
47
36
12

26
28
10
20
22
12
14
30
36
34
32
70

CONVERTIBLE BACKPACK

This is a continuation of application Ser. No. 08/074,715 filed on Jun. 9, 1993 which is a continuation of application Ser. No. 07/773,141 filed on Oct. 8, 1991 both abandoned.

BACKGROUND OF THE INVENTION

1. Field of the Invention

The present invention relates to backpacks. More specifically, the present invention relates to a convertible backpack that features a loop disposed on a back panel of the backpack to slideably retain a single shoulder strap passing therethrough and anchored to the backpack at its two ends.

2. Description of the Prior Art and Related Information

Backpacks and shoulder totes have been around for numerous years. They are useful for students as well as hikers and travellers. The conventional backpack is a sack having a sealable opening. Typically, the sack has some sort of handle to allow it to be carried like luggage. Also, the conventional sack usually includes a pair of shoulder straps so that the sack can be worn over the back.

Conventional design practice requires that the backpack have two separate shoulder straps, each connected at opposite ends to a common back panel of the backpack. The two shoulder straps are individually stitched to the back panel near the top of the backpack. In such an arrangement, each shoulder strap is anchored at the top and at the bottom so that their respective arm loops are disposed substantially vertically. A person wearing the backpack can conveniently slide each arm and shoulder through the vertically disposed loops.

Another popular feature in conventional backpacks is a length adjustment buckle located on each shoulder strap. In addition to the two shoulder straps, some conventional backpacks also feature a waist encircling belt fastened to the backpack near its base. When this backpack is worn, the shoulder straps are carried on the shoulders and the waist belt is wrapped around the wearer's midsection. Consequently, the backpack is tightly secured to the wearer's body. This level of security is only necessary for active backpackers such as hikers or mountain climbers.

Unfortunately, the conventional backpack has many shortcomings. For instance, sometimes it is preferable to wear the backpack over a single shoulder. This is true especially when carrying a light load inside the backpack. With the conventional backpack, the unused shoulder strap and waistbelt simply dangle in the air. Often, the dangling shoulder strap may catch on a bicycle seat, table edge, or some other protrusion. Other times, the dangling shoulder strap gets in the way and becomes a nuisance.

When the backpack is worn on the side over one shoulder as with a purse, it is positioned in a lower position relative to the wearer's body. The shoulder strap must be lengthened accordingly. But if the backpack is to be worn on the back again, the shoulder strap must be adjusted once more. Therefore, switching between the shoulder tote position and the backpack position requires constant readjustment of the shoulder strap.

Accordingly, a need presently exists for a backpack having self-adjusting shoulder straps. Preferably, the shoulder straps should be adaptable to be worn in a variety of ways on the body.

SUMMARY OF THE INVENTION

The present invention relates to a backpack having a centrally disposed anchoring loop to slidably secure a shoulder strap that is secured to the backpack at opposite ends. So configured, the present invention provides a backpack with a continuously adjustable and highly versatile shoulder harness system.

In a preferred embodiment, the present invention provides a backpack with a single shoulder strap anchored to a back panel of the backpack near its base at opposite ends of the shoulder strap. Near the top and at about the center of the back panel is an anchoring loop through which the shoulder strap passes. Although the anchoring loop is affixed to the back panel, the shoulder strap is free to pass back and forth therethrough. Also by virtue of the anchoring loop, the shoulder strap is kept from pulling away in a perpendicular direction from the top of the backpack. This anchoring loop feature is in stark contrast to prior art backpacks that have each shoulder strap firmly and immovably affixed to the top of the back panel.

Exploiting this slide through feature, the present invention backpack can be converted from single-shoulder wear to across-the-chest wear to double-shoulder wear. Since the shoulder strap is easily adjustable to give more slack to either the left side or the right side by virtue of its slideable connection with the anchoring loop, length adjustment is simplified. Thus, all slack in the shoulder strap can be pulled to one side of the anchoring loop allowing the backpack to be worn over one shoulder as with a purse. Alternatively, the shoulder strap can be lengthened on one side sufficient to pass the wearer's head and shoulder therethrough so that the shoulder strap drapes across from the top of one shoulder across the chest down to the opposite hip. In addition, the shoulder strap can be adjusted so that its length is evenly divided between either side of the anchoring loop, and worn on both shoulders as with a conventional backpack. All of these adjustments are performed easily and quickly by virtue of the slidethrough loop.

Accordingly, the present invention provides many advancements over the prior art. First, the backpack can be worn over one shoulder, two shoulders, or across the chest without cumbersome adjustments to the shoulder strap. Second, when the backpack is worn, the slidethrough loop permits adjustment of shoulder strap tension and side-to-side length even as it is worn. Consequently, the backpack is more comfortable to wear for long durations. Third, since the shoulder strap is continuously adjustable, the backpack is easier to put on or take off. Indeed, by simply pulling the shoulder strap to one side of the loop, more slack is created through which the wearer can insert his arm, shoulder, or body. With the backpack secured to one shoulder, the extra length in the shoulder strap can be pulled to the opposite side of the loop to create room for the remaining arm and shoulder. Fourth, only one length adjustment buckle is necessary since the shoulder strap is continuous from the left shoulder end to the right. Therefore, it is possible to save on production costs by using one less buckle and less material for the shoulder strap.

DETAILED DESCRIPTION OF THE INVENTION

In the following description, numerous details such as specific materials and configurations are set forth in order to provide a more complete understanding of the present invention. But it is understood by those skilled in the art that the present invention can be practiced without those specific details. In other instances, well-known elements are not described explicitly so as not to obscure the present invention.

The present invention is directed to a backpack employing a fully adjustable one-piece shoulder strap easily convertible from one form of carry to another. In a preferred embodiment, the backpack features a pass-through anchoring loop centrally disposed near the top of a back panel of the backpack. The single shoulder strap is anchored at opposite ends near the base of the backpack and passes through the loop. Importantly, the shoulder strap is free to slide laterally through the loop, yet the loop restricts the shoulder strap from pulling away from the backpack in a direction perpendicular thereto.

Figure 1:
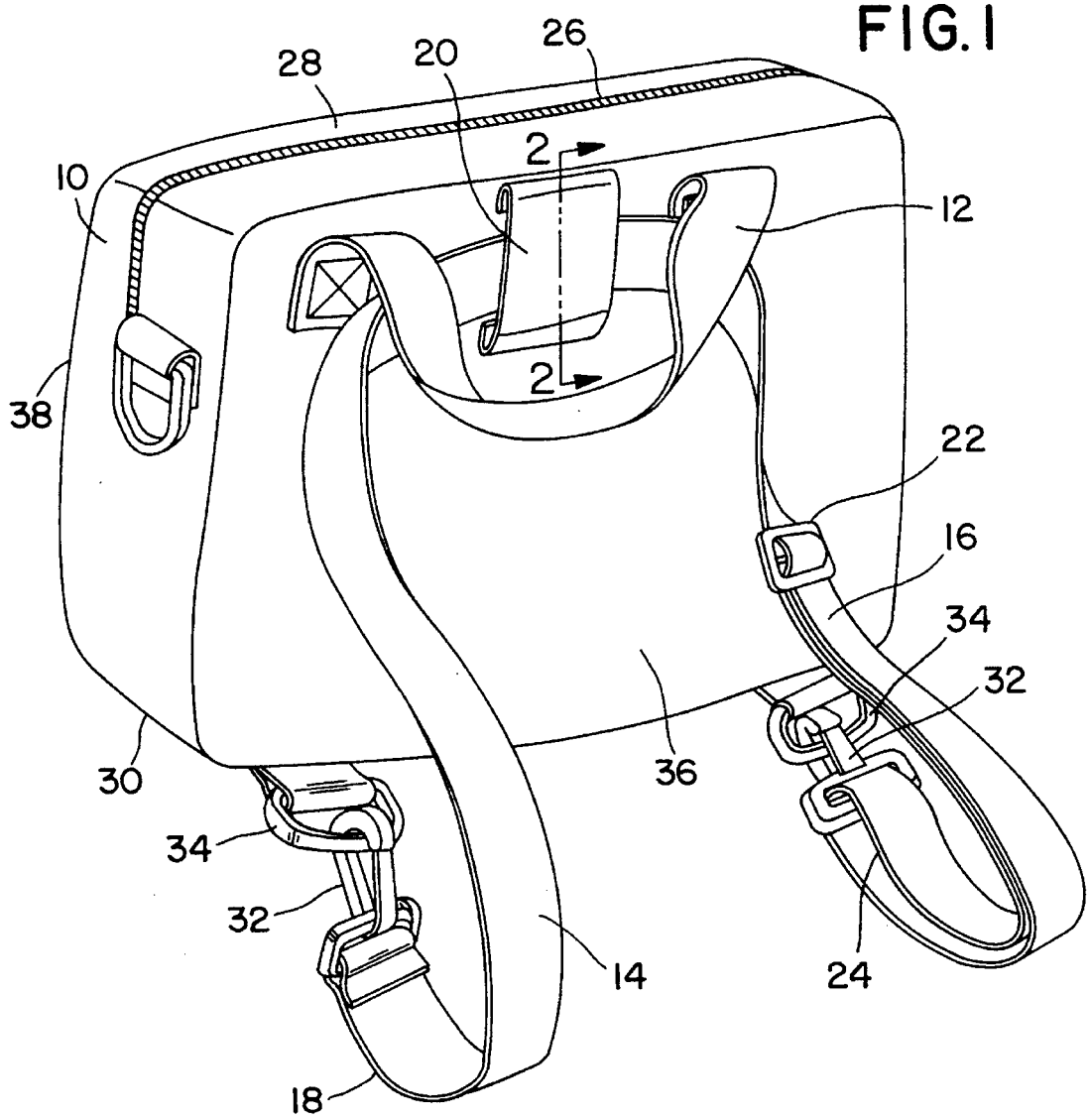
FIG. 1 is a perspective view of a preferred embodiment of the present invention, which view illustrates a backpack having a single, continuous shoulder strap and an anchoring loop centrally located on a back panel.
Figure 3:
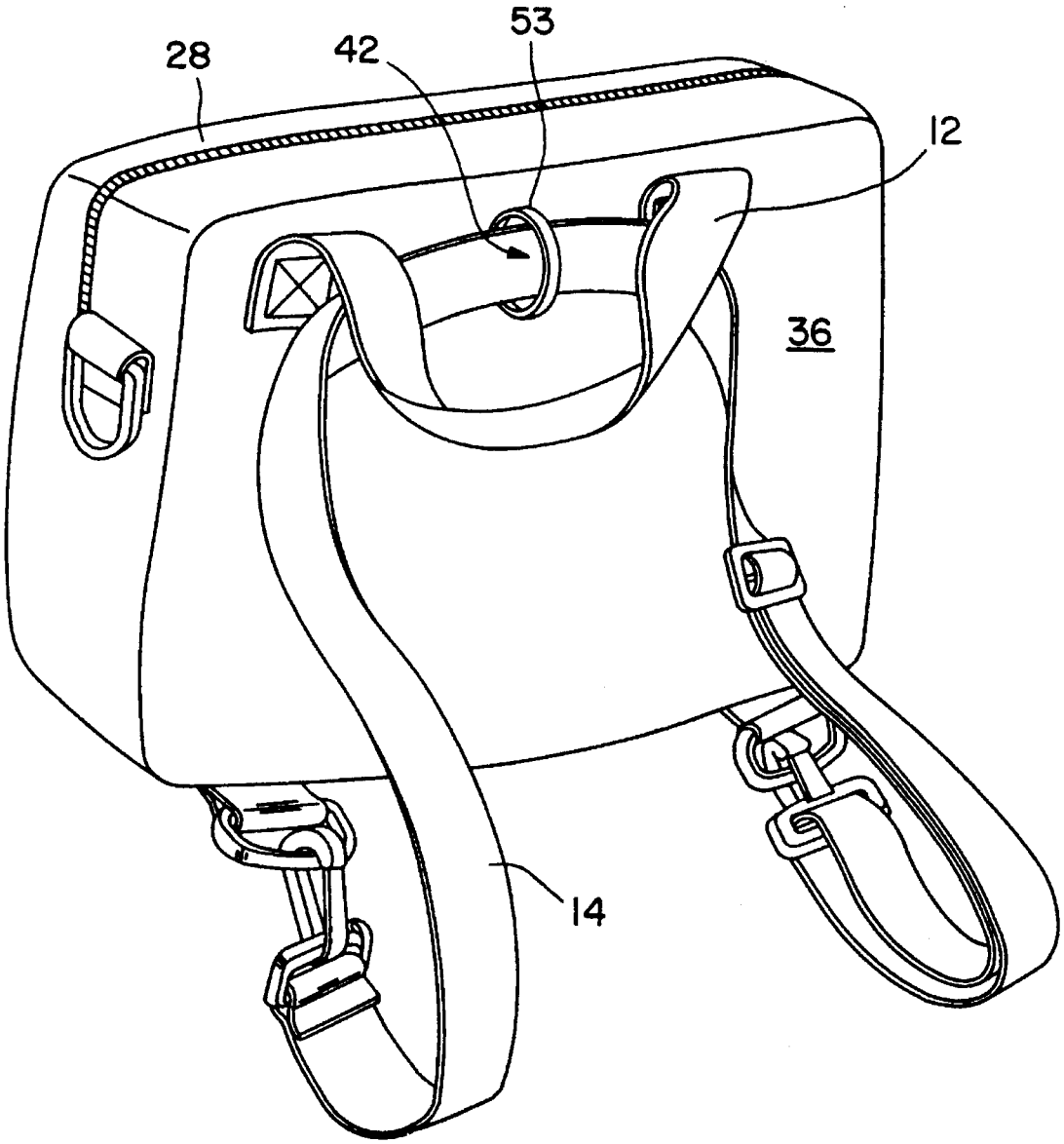
FIG. 3 is a perspective view of the present invention in which the anchoring loop comprises a ring.

FIG. 1 is a perspective view of the preferred embodiment of the present invention. According to the figure, the present invention backpack 10 has a substantially rectangular shape with polygonal sides. Although the backpack 10 is preferably made from conventional materials used in the construction of backpacks, including but not limited to canvas, polyester and leather, the backpack 10 may also be made from a polyamide material known for its durability so as to reduce the damage caused by wear and tear on the backpack 10. A means for opening and closing the backpack 10, such as a zipper 26, is located at the top 28. A handle 12 is provided for convenient carry as with conventional luggage. As shown in FIG. 3, the handle 12 is disposed on the back panel 36 with its two ends 45, 46 secured thereto proximate to the opposite sides of the anchoring loop 20 to define a passage 48 through the handle 12. The handle 12 may hang down as shown in FIGS. 1, 3, 4 and 5. Since backpacks and their construction are well known in the art, a detailed discussion thereof is not necessary.

The present invention provides an anchoring loop 20 on a back panel 36 of the backpack 10. More precisely, the loop 20 is located near the center and close to the top of the back panel 36. The back panel 36 is the side of the backpack 10 that, as the backpack 10 is worn over both shoulders in the traditional manner, ends up against the wearer's back. Passing through the loop 20 is a shoulder strap 14 anchored at its ends to the back panel 36 near the backpack base 30. In the preferred embodiment, the shoulder strap 14 is attached to the backpack 10 by use of a detachable hook 32 and ring 34. Other means of latching known in the art are, of course, possible.

Important to the shoulder harnessing system provided by the present invention is the anchoring loop 20 through which the shoulder strap 14 passes. This anchoring loop 20 permits sliding of the shoulder strap 14 therethrough for continuous length adjustment to create slack 50 or 70 in either the left side 16 or the right side 18 of the shoulder strap 14.

Figure 2:
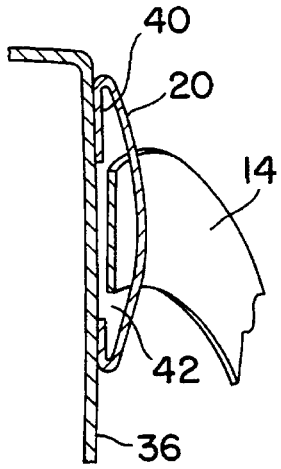
FIG. 2 is a sectional view of the anchoring loop taken along line 2—2 of FIG. 1.

FIG. 2 is a cross-sectional view of the loop 20 taken along line 2—2 of FIG. 1. In the preferred embodiment, the anchoring loop 20 has a rectangular shape and is sewn to the back panel 36 of the backpack 10. Many other forms of attaching the loop 20 to the back panel 36 known in the art are possible, such as stitching, riveting, cementing, and the like. As shown clearly in FIG. 2, the shoulder strap 14 slides freely through the gap 42 formed between the loop 20 and the backside 36. The gap 42 permits lateral movement of the shoulder strap 14 but prevents the latter from pulling away from the back panel 36 in a perpendicular direction. The general tendency of the backpack 10 is to pull away from the shoulder strap 14 when the former is loaded and is carried by the latter.

As shown in FIG. 1, the shoulder strap 14 has a length adjustment buckle 22 in which the shoulder strap material doubles over 24 to allow lengthening or shortening of the shoulder strap 14. Since the shoulder strap 14 is continuous from the left side 16 to the right side 18, only one length adjustment buckle 22 is needed. More length adjustment buckles can be added depending on special need.

Figure 4:
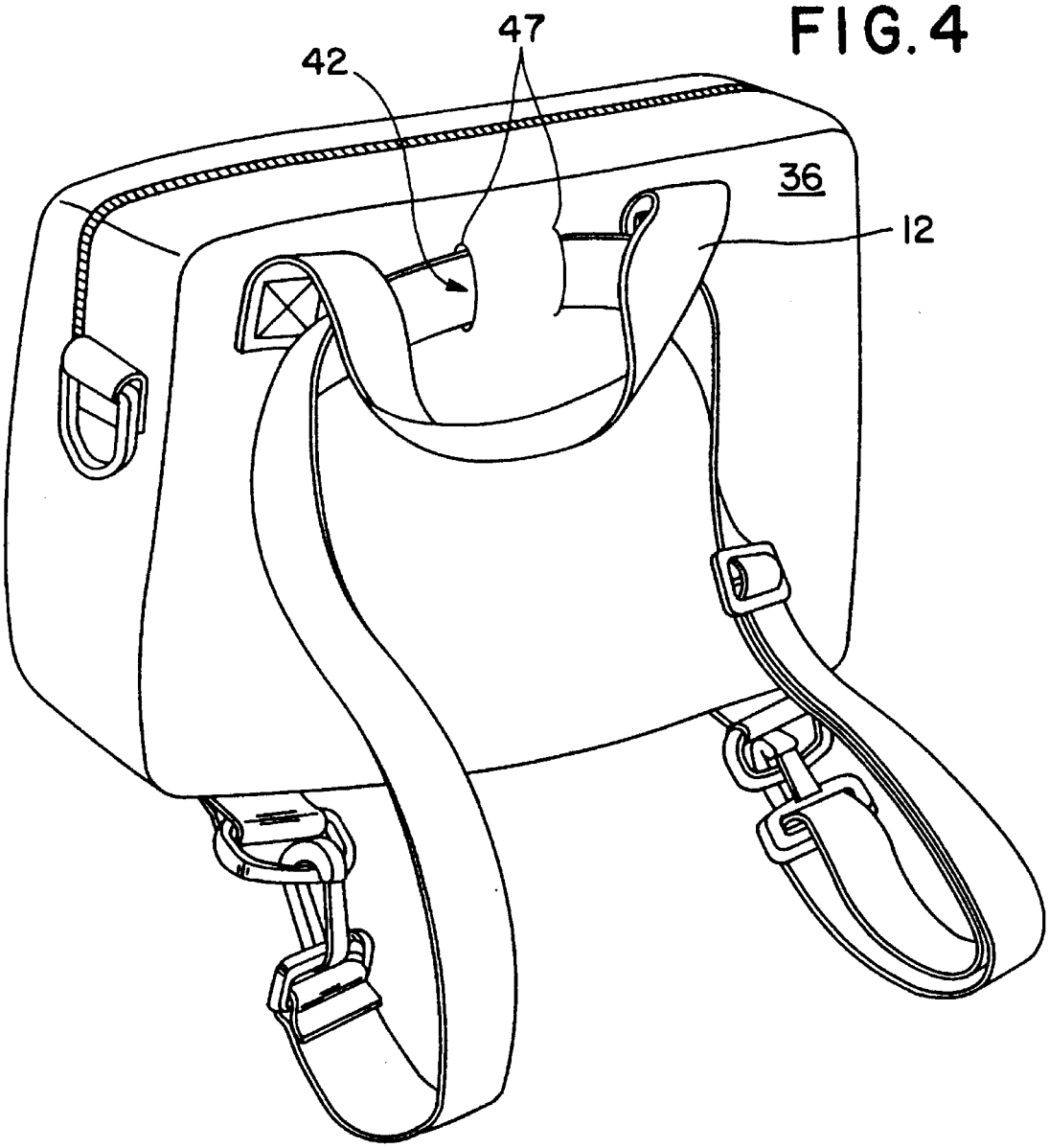
FIG. 4 is a perspective view of the present invention in which the anchoring loop is integrally constructed from the material of the back panel with the gap passing between two apertures formed in the back panel.
Figure 5:
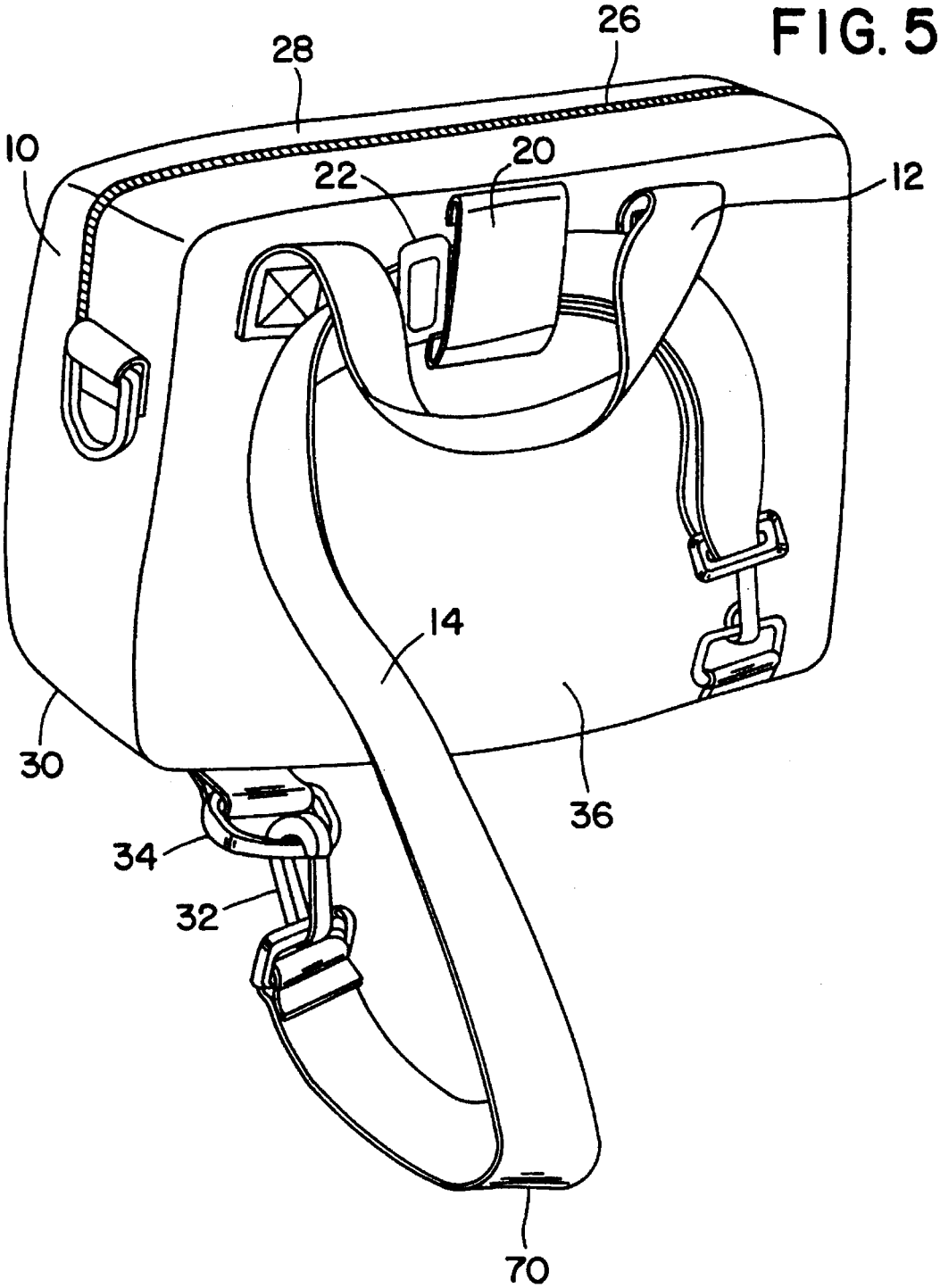
FIG. 5 is a perspective view of the present invention in which the slack of the shoulder strap is pulled below the handle and to the right side of the anchoring loop.

Numerous modifications are possible without departing from the spirit of this invention. For instance, the orientation and location of the anchoring loop 20 can be varied according to need. The anchoring loop can be a plastic or metal ring 53 as shown in FIG. 4, a ribbon or strip of fabric or leather as shown in FIG. 1, or twin apertures 47 provided in the back panel through which the shoulder strap can pass as shown in FIG. 5. In the event that the anchoring loop 20 is integrally formed from the back panel 36 by providing two apertures 47 therein, it is preferable that the material of the backpack 10 comprise a polyamide material which provides the durability needed to prevent the anchoring loop 20 tearing off of the back panel 36. So long as it is located substantially centrally to the outer two anchoring points of the shoulder strap 14, and so long as it is located substantially above the base 30 of the backpack 10, the anchoring loop 20 can perform its intended function. It is preferable that the anchoring loop 20 and the two anchoring points of the shoulder strap 14 form an imaginary triangle on the back panel 36.

What is claimed is:

1. A convertible backpack having a base and a top comprising:

a plurality of sides including a back panel, the plurality of sides defining an enclosure having means for opening and closing the enclosure disposed at the top of the backpack;

an anchoring loop secured to the back panel and arranged substantially vertically near the top of the backpack to provide a gap oriented horizontally;

a flexible handle having two ends disposed proximately to opposite sides of the anchoring loop and the ends secured to the back panel at one of a level of the anchoring loop and a level below the anchoring loop, thereby defining an opening through the handle; and a single shoulder strap having a first end connected to the back panel, a second end and an adjusting buckle, said second end and said adjusting buckle adapted to pass slidably through the anchoring loop, said second end connected to the back panel such that slack in the shoulder strap and the adjusting buckle may be pulled through the gap of the anchoring loop to provide a single shoulder harness in which the backpack is maintained in a substantially upright position when hung from a shoulder;

wherein the handle hangs below the anchoring loop when the backpack is in a substantially upright position.

2. The convertible backpack of claim 1, wherein the anchoring loop is integrally constructed out of the back panel by forming two apertures in the back panel in communication with each other such that the gap passes through the back panel.

3. The convertible backpack of claim 1, wherein the backpack is constructed from a polyamide material.

4. The convertible backpack of claim 1, wherein the first end of the shoulder strap is connected to a first corner of the back panel near the base, the second end is connected to a second corner of the back panel near the base such that the first end, the second end and the anchoring loop are arranged in an imaginary triangular shape coplanar with the back panel.

5. The convertible backpack of claim 1, wherein the means for opening and closing is a zipper.

6. The convertible backpack of claim 1, wherein the anchoring loop comprises a rectangular piece of material having opposite ends stitched to the back panel.

7. The convertible backpack of claim 1, wherein the first end and the second end of the shoulder strap have hooks to engage locking rings disposed on the back panel.

8. The convertible backpack of claim 1, wherein the anchoring loop is constructed from a material selected from the group consisting of plastic, metal and leather.

9. A convertible backpack having a base and a top comprising:

a plurality of sides including a back panel, the plurality of sides defining an enclosure having means for opening and closing the enclosure disposed at the top of the backpack;

an anchoring loop integrally constructed out of the back panel and having two apertures in communication with each other so as to define a gap in the back panel;

a flexible handle having two ends disposed proximately to opposite sides of the anchoring loop and the ends secured to the back panel at one of a level of the anchoring loop and a level below the anchoring loop, thereby defining an opening through the handle; and a single shoulder strap having a first end connected to the back panel, a second end and an adjusting buckle, said second end and said adjusting buckle adapted to pass slidably through the anchoring loop, said second end connected to the back panel such that slack in the shoulder strap and the adjusting buckle may be pulled through the gap of the anchoring loop to provide a single shoulder harness in which the backpack is maintained in a substantially upright position when hung from a shoulder;

wherein the handle hangs below the anchoring loop when the backpack is in a substantially upright position.

10. The convertible backpack of claim 9, wherein the first end of the shoulder strap is connected to a first corner of the back panel near the base, the second end is connected to a second corner of the back panel near the base such that the first end, the second end and the anchoring loop are arranged in an imaginary triangular shape on the back panel.

11. The convertible backpack of claim 9, wherein the shoulder strap has means for adjusting the length of the shoulder strap.

12. The convertible backpack of claim 9, wherein the means for opening and closing is a zipper.

13. The convertible backpack of claim 9, wherein the first end and the second end of the shoulder strap have hooks to engage locking rings disposed on the back panel.

* * * * *